United States Patent [19]

McCullough

[11] 3,969,788

[45] July 20, 1976

[54] DOOR LOCK HINGE

[76] Inventor: Richard C. McCullough, 11154 Eastwood Ave., Inglewood, Calif. 90304

[22] Filed: July 14, 1975

[21] Appl. No.: 595,381

[52] U.S. Cl. ..... 16/144

[51] Int. Cl.[2] ..... E05D 11/10

[58] Field of Search ..... 16/137, 141, 128 R, 16/147, 144, 139; 292/32, 41, 137, 163

[56] References Cited

UNITED STATES PATENTS

| | | | |
|---|---|---|---|
| 1,603,409 | 10/1926 | Rickenbacher | 16/144 |
| 1,758,309 | 5/1930 | Block | 16/141 |
| 2,890,478 | 6/1959 | Young | 16/144 |

*Primary Examiner*—G. V. Larkin
*Attorney, Agent, or Firm*—Ralph B. Pastoriza

[57] ABSTRACT

First and second plates are hinged together and designed such that the first plate can be secured to the inside frame or jamb of a door opening and the second plate swung from a position coplanar with the first plate to a right angle position to overlie the marginal face portion of a door when closed. The second plate mounts a bolt for sliding movement in a direction normal to the hinge axis, the hinge shaft having a receiving bore for receiving the bolt when the first and second plates are at right angles to thus lock the plates in right angle relationship. The door is thus secured against opening. The same arrangement may be utilized for hinge mounting cabinet doors wherein the hinge lock serves the dual function of a hinge as well as a lock.

8 Claims, 7 Drawing Figures

DOOR LOCK HINGE

This invention relates generally to door locks and more particularly to an internal security type lock operable from within a home to prevent outside entry and thus serve as a substitute for the well known "dead bolt".

BACKGROUND OF THE INVENTION

Many types of internal security locks for doors in offices and residences are well known. The most common takes the form of a throw bolt often referred to as a dead bolt type structure wherein the same is operable from the inside of the home or office to prevent entry from the exterior. The structures generally take the form of a simple bolt which can be manually slid into a receiving structure fixed to the door jamb.

In certain instances, the bolt is internally built into the edge of the door and is operated by a knob from the inside only to pass into an opening provided in the door jamb. In other less expensive types of dead bolts, the bolt is externally mounted to the face of the door adjacent its closing edge and a suitable metal fixture with a cut-out to receive the bolt screw fastened to the exterior frame of the door.

The former internal type of dead bolt is substantially stronger and more secure than the external types attached with screws. In both types, however, there is necessitated a certain amount of manual labor in installing the devices. Particularly is such the case with the internal type of dead bolt which requires woodworking operations on the door itself. Even in the latter mentioned external attachment types of bolts, screw holes must be made in the door and frame.

It would be highly desirable if a strong and secure dead bolt type of lock could be provided for doors which provided adequate strength and yet in no way required defacing of the door or even, in certain instances, the door frame in securing the same in place.

BRIEF DESCRIPTION OF THE PRESENT INVENTION

Bearing the foregoing in mind, the present invention contemplates an improved door lock which incorporates a hinge so designed that the problems associated with prior art types of dead bolt locks mentioned heretofore are avoided.

More particularly, in accord with the present invention, there is provided a first hinge plate having a hinge shaft means secured to an edge of the plate. A second hinge plate in turn includes journalling means at an adjacent edge surrounding a portion of the shaft to hinge the second plate to the first plate at the adjacent edges for swinging movement about the axis of the hinge shaft means. A bolt means is mounted on the second plate for sliding movement in a direction normal to the axis of the hinge shaft means, the hinge shaft means itself including a receiving bore normal to its axis positioned to receive the bolt means when the second plate is at right angles to the first plate.

With the foregoing arrangement, the plates may be locked in a right angle position so that when one plate is secured to the inside edge of a door frame, the other plate will simply overlie a marginal face portion of the door when closed to thereby hold the door closed.

In a first embodiment, the first plate to be secured to the inside frame for the door includes screw-fastening holes and a central cut-out to define a strike plate for the door so that this first plate may simply be substituted for the normal strike plate on the door frame, the same screw holes holding the normal strike plate being utilized to hold the first plate of the door hinge lock. By this arrangement, there is no defacing or necessity to provide new screw holes. It will be understood that the second plate will then simply overlie the marginal face of the door when in closed position to secure it against outside opening.

In a second embodiment, the door hinge lock may be provided with screw fastening holes on its second plate for securement to a door portion over which it overlies so that the door hinge lock will serve the function as a hinge for the door itself; such as a cabinet door, by way of example, as well as holding the door in its closed position.

BRIEF DESCRIPTION OF THE DRAWINGS

A better understanding of this invention will be had by now referring to the accompanying drawings in which.

DETAILED DESCRIPTION OF THE INVENTION

Figure 1:
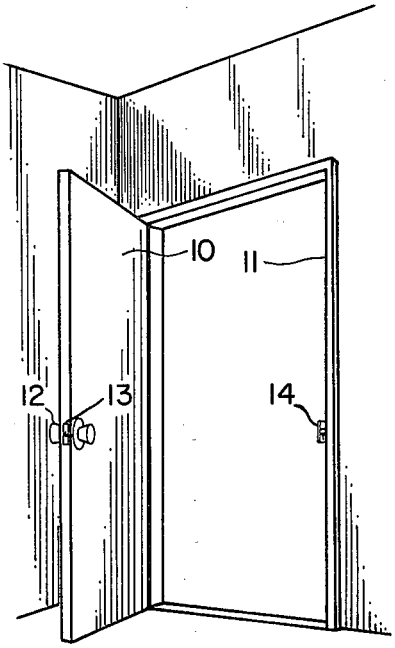
FIG. 1 is a perspective view of a portion of a room or office showing a door and door frame together with the door lock hinge of this invention mounted to the door frame.

Referring first to FIG. 1, there is shown a door 10 and corresponding door frame 11 in a room or office. As shown, the door 10 includes the usual door knob 12 and door latch 13. In accord with the particular embodiment to be described, the door lock hinge of the present invention is designated generally by the numeral 14 and is mounted to the inside of the door frame 11 in place of the normal strike plate provided to receive the door latch 13 when the door is closed.

Figure 2:
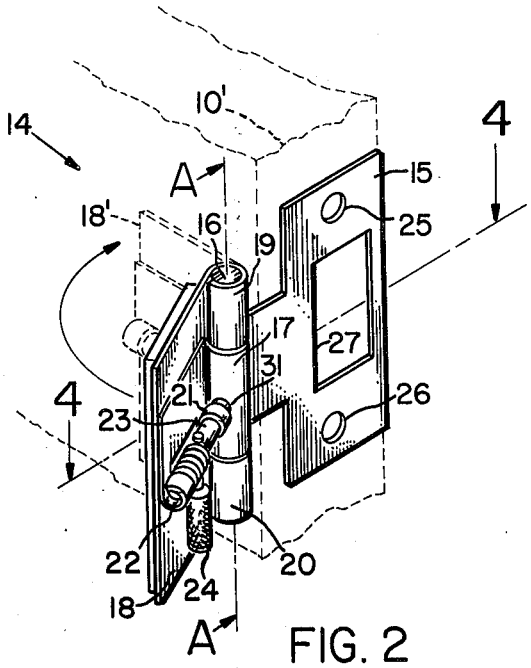
FIG. 2 is an enlarged perspective view of the door lock hinge of FIG. 1.

Referring now to FIG. 2, details of the door lock hinge of this invention will be described. In the perspective view of FIG. 2, the door lock hinge 14 is oriented substantially the same as shown in FIG. 1, the door 10 being depicted in closed position at 10' and the inside of the door frame or jamb 11 being omitted so that the door hinge lock itself will be visible.

As shown, the door lock hinge 14 includes a first plate 15 together with hinge shaft means including a hinge shaft 16 and a portion of the first plate 15 wrapped about the hinge shaft 16 as shown at 17. A second hinge plate 18 in turn includes journalling portions 19 and 20 surrounding end portions of the shaft 16. It will be understood that the first plate 15 is rigidly secured to the shaft 16 by the wrapped about portion 17 whereas the journalling portions 19 and 20 of the second plate 18 simply journal the end portions of the shaft so that the second plate 18 can swing relative to the first plate 15. This swinging movement takes place about the axis for the hinge shaft 16 designated A—A in FIG. 2.

A bolt means is mounted to the second plate 18. This structure includes spaced guide sleeves 21 and 22 secured to the second plate 18 and a bolt 23 slidable in the guide sleeves 21 and 22 in a transverse direction; that is, in a direction normal to the axis A—A of the hinge shaft 16. In the embodiment disclosed in FIG. 2, there is provided a lever 24 secured to the bolt 23 intermediate the sleeves 21 and 22 and extending normally therefrom. This lever 24 facilitates manual sliding movement of the bolt 23 in the sleeves 21 and 22.

Also in the embodiment disclosed in FIG. 2, it will be noted that the first plate 15 includes screw openings 25 and 26 together with a central cut-out 27. The design of the first plate is such as to define a strike plate for the door so that this first plate may simply be substituted for the normal strike plate on the door frame. Thus, in securing the door lock hinge of this invention, it is not necessary to in any way make any new holes or deface the door frame or door itself, all as will become clearer as the description proceeds.

As indicated by the dotted lines in FIG. 2, the second plate 18 can swing about the hinge shaft 16 to the dotted line position 18' such that this second plate will overlie a marginal face portion of the door when closed and in the position indicated at 10' in FIG. 2. As will also become clearer as the description proceeds, the second plate 18 is arranged to be locked in a right angle position relative to the first plate 15 by means of the bolt 23 when the second plate 18 is in the dotted line position 18' shown in FIG. 2.

Figure 3:
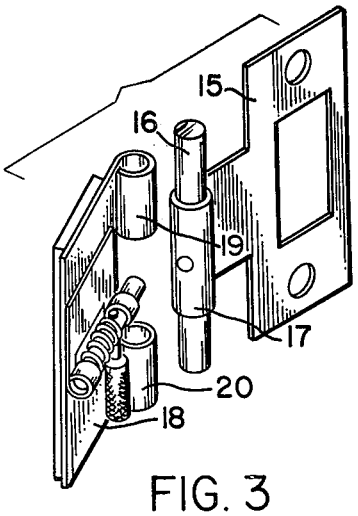
FIG. 3 is a fragmentary exploded perspective view of portions of the door lock hinge of FIG. 2.

Referring to FIG. 3, details of the hinging of the first and second plates 15 and 18 together will be evident. In FIG. 3, the plates are shown separated from each other wherein it will be clear that the journalling means 19 and 20 are secured to the second plate 18 whereas the shaft 16 is secured to the first plate 15 by the wrapped about portion 17.

Figure 4:
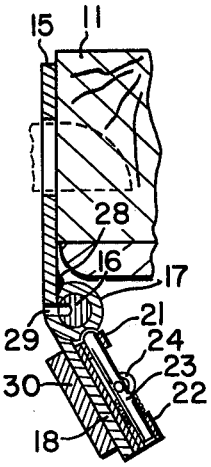
FIG. 4 is a cross section of the door lock hinge in a portion of the door frame looking vertically downwardly in the direction of the arrows 4—4 of FIG. 2.

In the cross section of FIG. 4, the rigid securement of the wrapped about portion 17 to the hinge shaft 16 is accomplished by welding as at 28. Also shown in FIG. 4 is a receiving bore 29 passing through the wrapped about portion 17 and extending into the hinge shaft 16. This bore 29 is so positioned as to be capable of receiving the bolt 23 on the second plate 18 when the second plate is at right angles to the first plate.

Figure 5:
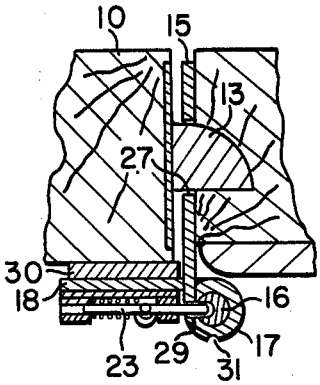
FIG. 5 is a view similar to FIG. 4 showing the door in closed and locked position.

Referring to FIG. 5, there is shown the first and second plates 15 and 18 in their right angle position wherein the bolt 23 has been received within the receiving bore 29 in the shaft 16. It will be immediately evident that the second plate 18 is locked in its right angle relative position to the first plate 15 when the bolt 23 is received in the receiving bore 29. It will also be evident that the door 10 cannot be swung open as a consequence of the overlying portion of the second plate 18.

In both FIGS. 4 and 5 there is shown a spacer plate 30 secured to the plate 18 which in some instances might be required to assure that the overlying second plate snugly engages the marginal face of the door when in closed position.

Also in FIG. 5 there is indicated the latch 13 of the door passing through the cut-out 27 and the first plate 15. It will be appreciated that even if the door lock is picked to retract the latch 13 or even if the latch is cut from the exterior, the door 10 still cannot be swung inwardly because of the presence of the door lock hinge. Further, it will be evident that any external force applied to the door will be adequately resisted by the bolt 23 and receiving bore 29, the applied force being transversely directed against the bolt 23 close to the point it enters the receiving bore 29. By having the receiving bore pass into the shaft 16 itself as well as through the wrapped about portion 17 of the first plate, a very strong and secure structure results.

With respect to the foregoing, it should be understood that while the first plate has been described as rigidly secured to the hinge shaft 16, the second plate could be rigidly secured to this shaft and the wrap-about portion 17 of the first plate arranged to journal the shaft. In this latter instance, the bolt 23 would simply pass into a receiving bore in the wrap-about portion 17 rather than extending on into the shaft 16. Thus, the embodiment as illustrated is preferable.

While not essential to the invention, it is preferable to provide an additional receiving bore such as indicated at 31 which may be in the form of a dimple in the wrapped about portion 17 of the first plate. This additional receiving bore will receive the end of the bolt 23 when the second plate is opened to permit opening of the door and serves as a convenience to prevent interference of the second plate when it is not desired to lock the door.

Figure 6:
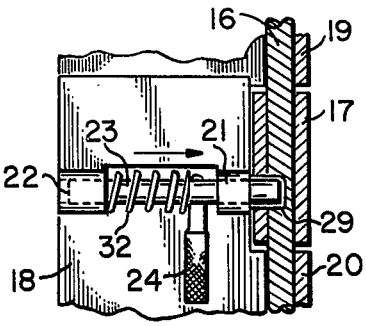
FIG. 6 is a fragmentary front elevational view of the door lock hinge illustrating an optional feature; and, FIG. 7 is a cross section looking downwardly of the door lock hinge adapted as a cabinet door hinge and lock structure.

Referring to FIG. 6 there is shown in fragmentary front elevational view the bolt 23 and cooperating spaced guide sleeves 21 and 22. In this showing, the bolt is received within the receiving bore 29 in the shaft 16 and thus the door lock hinge is in its locked position. In the particular showing of FIG. 6, there is additionally provided a compression spring 32 extending between the one guide sleeve 22 furthest from the edge of the second plate 18 and the lever 24 to bias the bolt towards the receiving bore so that the bolt will automatically snap into the receiving bore when the second plate forms a right angle with the first plate. Releasing of the lock structure, of course, is readily accomplished by manually sliding the bolt 23 by means of the lever 24 against the bias of the spring 32 to remove the bolt from the receiving bore 29.

It will be appreciated from the foregoing that the same compression spring 32 will cause the bolt 23 to snap into the additional receiving bore 31 to hold the hinge plates in open position when the same are not to be used for locking purposes.

Figure 7:
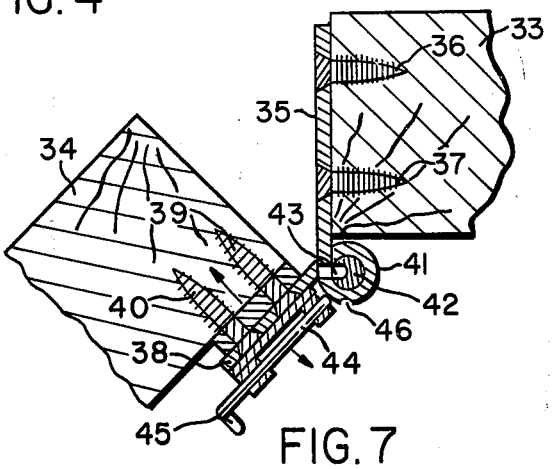

Referring now to FIG. 7 there is illustrated an application of the present invention wherein the door lock hinge can be utilized as both a locking and a hinging structure for doors such as cabinet doors. Thus, in FIG. 7 there is shown a portion of a frame 33 for a cabinet door 34 to be hinged to the frame. In this instance, a first plate 35 of the door hinge lock of this invention is secured by screws 36 and 37 to the frame 33, the second plate 38 similarly being secured by screws 39 and 40 to the marginal face of the cabinet door 34 which it overlies. A wrap-around portion 41 constituting an integral part of the first plate 35 is secured to a hinge shaft 42 in turn journalling the second plate 38 to the hinge shaft in the same manner as described in conjunction with FIGS. 2 and 3.

Also common with this structure described in the first embodiment is a receiving bore 43 passing through the wrap-about portion 41 and hinge shaft 42 positioned to receive a bolt 44 in guide sleeves mounted to the second plate 38 when the plates are at right angles to each other; that is, when the cabinet door 34 is closed.

Where the door lock hinge is utilized to hinge a cabinet door, the manual lever secured to the bolt may be provided on the end of the bolt rather than in an intermediate position between the guide sleeves. Thus, as shown in FIG. 7, there is provided a lever 45 at the end of the bolt 44. The reason why the lever may be positioned at the end of the bolt rather than intermediate the sleeves is that there is no problem of possible interference of the bolt with the door knob since the door lock hinge when utilized as a cabinet hinge is on the opposite side of the door from the normal door knob. However, it will be understood that the lever 45 could be positioned intermediate the sleeves as described in conjunction with the first embodiment of the invention.

The hinge lock structure of FIG. 7 thus not only provides a lock for holding a cabinet door closed but also serves as a hinge. It will be understood that two identical such hinges would normally be provided spaced adjacent the upper and lower edges of the cabinet door although such is not essential. In addition, additional receiving bores such as indicated at 46 in the wrap-about portion 41 of the first plate may be provided for indexing the bolt 44 when the cabinet door is open to hold the door open.

While no spring has been illustrated in FIG. 7 for biasing the bolt towards the receiving bore of the hinge shaft, such a spring could be provided if desired although such is not necessary in any of the embodiments described.

From the foregoing description, it will be evident that the present invention has provided a vastly improved security lock for homes and offices wherein when the device is utilized as a substitute for a dead bolt on an office door or residence door, it is not necessary to deface the door itself or for that matter the door frame when one of the plates is substituted for the strike plate. However, it is not necessary that the first plate be substituted for the strike plate, it being evident that the first plate could be secured any place along the inside margin of the door frame and the lock function to hold the door in its closed position.

Modifications falling with the scope and spirit of this invention will occur to those skilled in the art. The door lock hinge is therefore not to be thought of as limited to the specific embodiments set forth merely for illustrative purposes.

What is claimed is:

1. A door lock hinge comprising, in combination:

a. a first hinge plate;

b. hinge shaft means secured to an edge of said first hinge plate;

c. a second hinge plate having journalling means at an edge adjacent to said first mentioned edge surrounding at least a portion of said hinge shaft means to hinge said second plate to said first plate at the adjacent edges for swinging movement about the axis of said hinge shaft means; and, d. bolt means mounted on said second plate for sliding movement in a direction normal to the axis of said hinge shaft means, said hinge shaft means including a receiving bore normal to its axis positioned to receive said bolt means when said second plate is at a right angle to said first plate whereby said plates may be locked in a right angle position so that when one plate is secured to the inside edge of a door frame, the other plate will overlie a marginal face portion of a door when closed to thereby hold said door closed.

2. A door lock hinge according to claim 1, including first and second spaced coaxial guide sleeves secured to said second plate, said bolt means including a bolt passing through said sleeves and guided thereby to be received in and removed from said receiving bore.

3. A door lock hinge according to claim 2, in which said first plate includes screw fastening holes and a central cut-out to define a strike plate for a door whereby said first plate may be substituted for the normal strike plate on the door frame, said second plate then overlying the marginal face portion of the door adjacent to the door knob to secure said door in a closed position.

4. A door lock hinge according to claim 3, including an operating lever secured to a central portion of said bolt between said guide sleeves and extending from said bolt at right angles to facilitate manual sliding of said bolt in said guide sleeves; and a compression spring between the one guide sleeve furthest from said edge of said second plate and said lever to bias said bolt towards said receiving bore so that the bolt will automatically snap into said receiving bore when said second plate forms a right angle with said first plate.

5. A door lock hinge according to claim 2, in which said first plate includes screw fastening holes for securing it to an inside portion of the door frame, said second plate having screw fastening holes for securing it to the marginal face portion of the door which it overlies so that said door lock hinge functions as a hinge for swinging movement of said door and also as a means for locking said door when in closed position.

6. A door lock hinge according to claim 5, including an operating lever at the far end of said bolt outside the guide sleeve furthest from said edge of said second plate to facilitate manual sliding of said bolt in said guide sleeves.

7. A door lock hinge according to claim 1 in which said hinge shaft means includes an additional receiving bore for said bolt means circumferentially spaced from said first mentioned receiving bore to receive said bolt means when said door is in a given open position to thus hold said door in said open position.

8. A door lock hinge according to claim 1, in which said hinge shaft means includes a hinge shaft and a portion of said first plate wrapped about said hinge shaft to secure it rigidly to said edge of said first plate, said receiving bore passing transversely through said portion and into said hinge shaft.

* * * * *